US005790035A

United States Patent [19]

Ho

[11] Patent Number: 5,790,035

[45] Date of Patent: Aug. 4, 1998

[54] REUSABLE TEMPERATURE AND WETNESS ALARM DEVICE FOR THE DIAPER

[76] Inventor: Geng Kaung Ho, 1119 Grassmere Dr., Richardson, Tex. 75080

[21] Appl. No.: 577,854

[22] Filed: Dec. 22, 1995

Related U.S. Application Data

[63] Continuation of Ser. No. 510,318, Aug. 2, 1995, abandoned.

[51] Int. Cl.[6] ..... G08B 21/00

[52] U.S. Cl. ..... 340/604; 128/886; 340/573; 340/603; 340/620

[58] Field of Search ..... 128/886; 340/573, 340/604, 602, 603, 605, 620

[56] References Cited

U.S. PATENT DOCUMENTS

| | | | |
|---|---|---|---|
| 4,264,901 | 4/1981 | Petersen et al. | 340/604 |
| 4,977,906 | 12/1990 | Di Scipio | 340/604 |
| 5,258,745 | 11/1993 | Colling | 340/604 |
| 5,291,181 | 3/1994 | DePonte | 128/886 |
| 5,392,032 | 2/1995 | Kline et al. | 128/886 |
| 5,408,222 | 4/1995 | Yaffe et al. | 340/604 |
| 5,416,469 | 5/1995 | Colling | 128/886 |
| 5,486,814 | 1/1996 | Quinones | 340/604 |

*Primary Examiner*—Jeffrey Hofsass
*Assistant Examiner*—Timothy Edwards, Jr.

[57] ABSTRACT

This invention provides a wetness alarm device to detect the temperature deviation or the new wetness in the diaper to indicate the new urine issue and to transmit the wetness alarm to human. The number of urine issue is counted, and will be used to affect the wetness alarm. A remote alarm may also be used. An emergency alarm may be activated when the whole device is submerged in the water or urine.

2 Claims, 1 Drawing Sheet

REUSABLE TEMPERATURE AND WETNESS ALARM DEVICE FOR THE DIAPER

CROSS-REFERENCE TO RELATED APPLICATION

This application is a continuation of patent application Ser. No. 08/510,318 filed Aug. 2, 1995 by Ho, Geng-Kaung now abandoned.

BACKGROUND OF THE INVENTION

This invention is related to alarm devices responsive to the presence of wetness in the diaper.

Previous inventions related to wetness detecting devices for the diaper were equipped with the diaper. Once the baby diaper is thrown away due to wetness, the wetness detecting device is also thrown away. Some wetness detecting devices may be reusable, they detect the wetness of the diaper and issue the alarm. However the alarm may not indicate the times of the urine issue. The alarm does not tell the guardian, who wants to wait until the wearer issues urine a certain times before changing the diaper, how many times the wearer has issued urine. It is therefore necessary to design, for the diaper, a wetness detecting device which is reusable and able to issue alarm with the information about times of urine issue.

SUMMARY OF THE INVENTION

This invention provides a reusable wetness alarm apparatus for the diaper. The device of the apparatus consists battery, device tester, battery monitor, sensor, alarm controller, and alarm generator. The battery supplies the electric power for the device. The device tester allows the guardian to test the usefulness of the device. The battery monitor monitors the usefulness of the battery and send signal to indicate the low charge of the battery to the alarm controller. The sensor detects the new urine issue in the diaper. The temperature deviation coming with new urine issue can be the input of the sensor. The new wetness coming with new urine issue can also be the input of the sensor. Once sensor detects the new wetness in the diaper, it will notify the alarm controller. Upon receiving the notification from sensor, the alarm controller will increment wetness count and notify the alarm generator, which in turn will issue the alarm to remind the guardian to change the diaper. The notification to alarm generator will depend on the wetness count. The notification from battery tester to alarm controller will also reset the wetness count.

The alarm generator may send a modulated alarm to a remote alarm generator to issue an alarm remotely. When the whole device is submerged in the urine or water, an emergency alarm may be issued.

It is therefore a primary object of this invention to provide a reusable wetness alarm device for the diaper to detect the temperature deviation coming with the new urine issue.

It is another object of this invention to provide a reusable wetness alarm device for the diaper to detect new wetness coming with the new urine issue.

It is another object of this invention to provide a reusable wetness alarm device for the diaper to count times of urine issue and to issue the alarm accordingly.

It is another object of this invention to provide a reusable wetness alarm device for the diaper to issue remote alarm.

It is another object of this invention to provide a reusable wetness alarm device for the diaper to issue an emergency alarm when the whole device is submerged in the urine or water.

BRIEF DESCRIPTION OF THE DRAWINGS

The objects and others will become more apparent with reference to the appended drawings, where in.

DESCRIPTION OF THE PREFERRED EMBODIMENT

Figure 1:
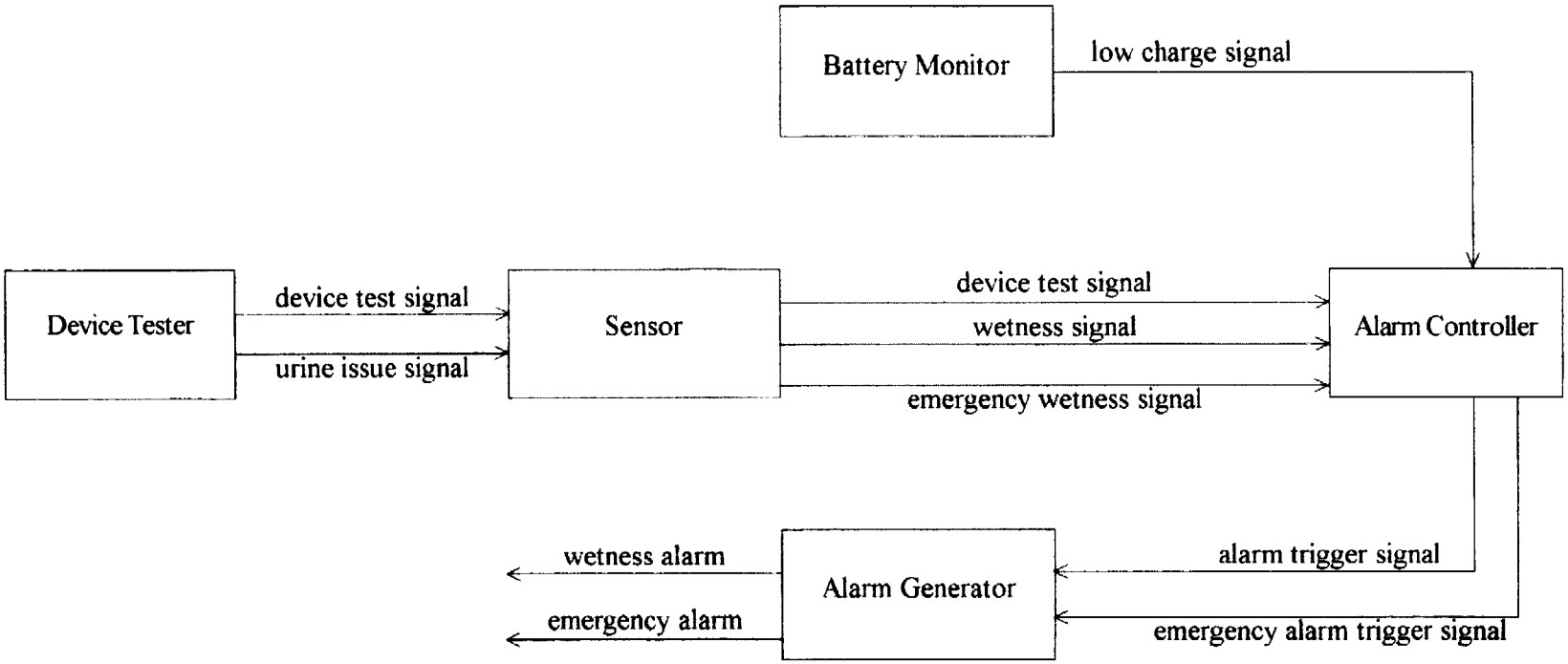
FIG. 1 is the block diagram of the invention.

Referring to FIG. 1, this invention provides a wetness alarm device (device hereafter) for diaper which is composed of a battery (not shown), a device tester, a battery monitor, a sensor, an alarm controller, and an alarm generator. Said battery supplies the electric power to said device. Said device tester is responsible to test said device. When the user of said device, usually the guardian of the wearer or baby sitter (guardian hereafter), performs the test of said device, said device tester will send a device test signal to said sensor. And said sensor will pass said device test signal to said alarm controller. Upon receiving said device test signal, said signal controller will send an alarm trigger signal to said alarm generator, if the electric charge in the battery is good enough and said device is functional. Upon receiving said alarm trigger signal, said alarm generator will issue an audible and/or visible signal to indicate the usability of said device. If said battery is dead, or said device is not functional said alarm generator will issue no audible and/or visible signal. Therefore, the guardian will recognize the time to replace the battery or even said device. Said battery monitor, consisting of a battery voltage or charge circuit, is responsible for monitoring the usefulness of said battery. A low charge signal may be sent from said battery monitor to said alarm controller. Upon receiving said low charge signal, said alarm controller will send alarm trigger signal to said alarm generator. The guardian will then change said battery, for supplying enough electric power to said device. An indicator, ex. LCD, may indicate the low charge of said battery. Said device tester may be simply a normal open switch connecting two conductive leads electrically isolated from each other. Closing said switch will electrically connect two said conductive leads and drop the electric resistance between them. And the drop of the electric resistance will become said device test signal.

The normal functionality are performed by said sensor, said alarm controller, and said alarm generator. Said sensor may be equipped with a temperature detector. Said temperature detector may consist of a ambient temperature lead and a urine temperature lead. Said ambient temperature lead is kept away from the reach of the urine and stays at the ambient temperature. Said urine temperature lead can be reached by the urine, and stays at the ambient temperature until reached by the urine.

At the time when the wearer issues the urine, said temperature detector will detect the deviation of the temperature between two leads. Said sensor may also be simply equipped with a resistance sensor. Said resistance sensor may be, for example, two sensor leads made of electric conductor. The electric resistance between two said sensor leads are huge while there is no urine between them. And will be dropped promptly at the time that wearer issues the urine. The temperature deviation or the drop of the electric resistance will become the urine issue signal as the input to said sensor.

Upon receiving said urine issue signal, said sensor will send wetness signal to said alarm controller. Said alarm controller will then increment the wetness count and determine the way to send alarm trigger signal to said alarm generator.

Different numbers of alarm trigger signals may also reflect the different wetness counts. More number of alarm trigger signals may be sent for more numerous wetness counts. For instance, one alarm trigger signal may be sent for one wetness count. And two alarm trigger signals for two wetness counts, etc. Different lengths of alarm trigger signal may also reflect the different wetness counts. Longer alarm trigger signal may be for more wetness count. Different frequencies of alarm trigger signal may also reflect the different wetness counts. Wetness signal with higher frequency may be sent for higher wetness count.

Said alarm generator issues said wetness alarm strictly faithfully to said alarm trigger signal. Different alarm trigger signals sent to said alarm generator will cause it to issue different wetness signals to the guardian. The guardian then figures out times of urine issue by different wetness alarm, and decides the need to change the diaper for the wearer. Said alarm trigger signal may be sent periodically rather than continually. During each period there may be a number of said alarm trigger signals following a quite time. This will save the energy of battery. The period may be same for different wetness counts. If the period is one minute, said alarm trigger signal is only sent one time for each minute. The period may also reflect said wetness count. Short period may be for high wetness count. There may be a limit for the number of periods to send said alarm trigger signal. For instance, the limit may be set as three, and there will be only three periods of time for said device to issue said wetness alarm. This way the guardian will only be notified three times for each new urine issue. The limit for the number of periods may also reflect said wetness count. Larger limit number may be issued for higher said wetness count. Said wetness count may be reset to zero once the guardian perform test against said device.

Figure 2:
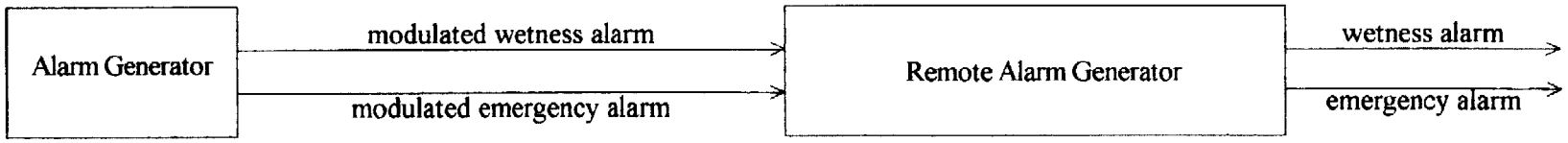
FIG. 2 indicates a remote alarm generator working with the alarm generator.

Referring to FIG. 2, a remote alarm generator may be used to receive said wetness alarm. In this case, said wetness alarm may be modulated with a radio carrier. The modulated wetness alarm will be sent through air to said remote alarm generator. A demodulator will be equipped in said remote alarm generator to demodulate said modulated wetness alarm and issue audible and/or visible wetness alarm to the guardian. Said remote alarm generator is usually located at the place where the guardian can sense the audible and/or visible wetness alarm. Also, a power supply should be equipped for said remote alarm generator.

Said remote alarm generator is also used for saving the wearer of the diaper from drowning. An extra wetness detector (hidden wetness detector hereafter) may be added to said sensor of said device. It is virtually hidden in said device and will not be reached by the urine sprinkling and is idle, until it or the whole said device is submerged in the urine or water. When the wearer falls into the pool, said hidden wetness detector will detect the wetness and cause said sensor sending a emergency wetness signal to said alarm controller. Upon receiving said emergency wetness signal, said alarm controller will send a emergency alarm trigger signal to said alarm generator and cause it to send a modulated emergency wetness alarm to said remote alarm generator. Upon receiving said modulated emergency wetness alarm, said-remote alarm generator will issue a emergency alarm to warn the guardian to save the wearer from being drown.

I claim:

1. A reusable wetness alarm device for the diaper to detect the wetness in it and to issue the wetness alarm comprising:

a. a battery to supply the electric power for said wetness alarm device;

b. a device tester to test the usefulness of said wetness alarm device including said battery;

c. a battery monitor to monitor the usefulness of said battery, and to indicate the lack of electric charge in said battery;

d. an alarm generator to generate an audible and/or visible wetness alarm to human, when the wearer issues urine;

e. an alarm controller to increment the wetness count for each new urine issue in the diaper and trigger said alarm generator to generate said wetness alarm;

f. a sensor consisting two wetness sensor leads made of electrically conductive material, to detect the drop of electric resistance between them, caused by the new urine issue in the diaper, and to notify said alarm controller;

g. a temperature deviation detector equipped in said sensor to detect the temperature deviation caused by a new urine issue in the diaper;

h. an alarm means to issue said wetness alarm with different counts, lengths, or frequencies of signals to reflect the different said wetness counts;

i. an alarm means to issue said wetness alarm periodically rather than continually, for saving the energy of said battery;

j. an alarm means to issue only a limited number of said wetness alarm for each new urine issue, for warning only a limited times;

k. a means to reset said wetness count when the user of said wetness alarm device performs test against it.

2. A reusable wetness alarm device for the diaper to detect the wetness in it and issue the wetness alarm to a remote receiver comprising:

a. a battery to supply the electric power for said wetness alarm device;

b. a device tester to test the usefulness of said wetness alarm device including battery;

c. a battery monitor to monitor the fullness of said battery, and to indicate the lack of electric charge in said battery;

d. an remote alarm generator with its own power supply, to generate an audible an/or visible wetness alarm to human, when the wearer issues urine;

e. an alarm generator to send a modulated wetness alarm to said remote alarm generator through air, so said remote alarm generator may demodulate said modulated wetness alarm and generate said audible and/or visible wetness signal;

f. an alarm controller to increment the wetness count for each new urine issue in the diaper and trigger said alarm generator to generate said wetness alarm;

g. a sensor consisting two wetness sensor leads made of electrically conductive material, to detect the drop of electric resistance between them, caused by the new urine issue in the diaper, and to notify said alarm controller;

h. an extra wetness sensor, to allow said wetness alarm device to issue an emergency wetness alarm while said extra wetness sensor is submerged in the urine or water;

i. a temperature deviation detector to detect the temperature deviation caused by a new urine issue in the diaper;

j. an alarm means to issue said wetness alarm with different counts, lengths, or frequencies to reflect the different said wetness counts;

k. an alarm means to issue said wetness alarm periodically rather than continually, for saving the energy of said battery;

l. an alarm means to issue only a limited number of said wetness alarm for each new urine issue, for warning only a limited times;

m. a means to reset said wetness count when the user of said wetness alarm device performs test against said it.

* * * * *